United States Patent [19]

Naveau et al.

[11] Patent Number: 4,751,960

[45] Date of Patent: Jun. 21, 1988

[54] APPARATUS AND METHOD FOR COOLING A CONTINUOUSLY CAST METAL PRODUCT

[75] Inventors: Paul P. Naveau, Alleur; Stéphan H. Wilmotte, Chaudfontaine, both of Belgium

[73] Assignee: Centre de Recherches Metallurgiques-Centrum Voor Research in de Metallurgie, Brussels, Belgium

[21] Appl. No.: 27,480

[22] Filed: Mar. 18, 1987

[30] Foreign Application Priority Data

Mar. 18, 1986 [BE] Belgium ..... 6/48206

[51] Int. Cl.[4] ..... B22D 11/124

[52] U.S. Cl. ..... 164/486; 164/444

[58] Field of Search ..... 164/443, 444, 485, 486, 164/487

[56] References Cited

U.S. PATENT DOCUMENTS 3,512,574 5/1970 Taylor ..... 164/487

FOREIGN PATENT DOCUMENTS

| | | | |
|---|---|---|---|
| 675403 | 1/1966 | Belgium . | |
| 1558302 | 4/1970 | Fed. Rep. of Germany . | |
| 2143962 | 3/1972 | Fed. Rep. of Germany . | |
| 1055891 | 2/1954 | France | 164/444 |
| 67701 | 3/1958 | France . | |
| 2153152 | 5/1973 | France . | |
| 2317980 | 2/1977 | France . | |
| 48-13811 | 5/1973 | Japan | 164/444 |
| 59-189052 | 3/1985 | Japan . | |
| 577352 | 7/1976 | Switzerland | 164/444 |

*Primary Examiner*—Kuang Y. Lin

*Attorney, Agent, or Firm*—Holman & Stern

[57] ABSTRACT

In a secondary cooling zone below a continuous casting mold there is provided one or more chambers having an anterior wall with apertures facing the continuously cast metal product at a given distance from the surface of the product. Pressurized cooling liquid is supplied to the apertures to form a continuous layer of pressurized cooling liquid flowing in the direction of travel of the product.

9 Claims, 2 Drawing Sheets

APPARATUS AND METHOD FOR COOLING A CONTINUOUSLY CAST METAL PRODUCT

BACKGROUND TO THE INVENTION

1. Field of Invention

The present invention relates to apparatus for cooling a continuous rolling metal product, more particularly a steel product, manufactured by continuous casting, and a method for operating the apparatus.

2. Description of Prior Art

It is known that continuous casting of a metal product is a method which consists in casting the molten metal in a bottomless mold which is usually oscillated and the walls of which are cooled energetic. The effect of the energetic cooling is that the skin of the cast metal solidifies rapidly and forms a solid crust surrounding the molten metal which forms the liquid core. The product which is partly solidified is then extracted continuously from the mold and passes through a secondary cooling zone where it finishes cooling and, consequently, solidifying.

The presence of the liquid core brings about ferrostatic pressure inside the product. This ferrostatic pressure acts from the inside on the solidified skin and can cause perforations, i.e. cracks in the skin, in the places where the skin is not adequately resistant. These weak points are the result in particular of uneven cooling or inadequate support of the product in the secondary cooling zone.

The conventional plant for a secondary cooling zone comprises support rollers and guide rollers, between which water spraying devices are disposed, for example jets.

Using equipment of this type does, however, entail two major disadvantages which can lead to the weak points mentioned above. On the one hand, the metal is only firmly held along the contact generatrices of the rollers, which constitutes a serious risk of perforation between two rollers and gives rise to convex deformations. On the other hand, the cooling jets alternate with the rollers along the path of the product. The product therefore undergoes a series of coolings and heatings, i.e. a series of thermal cycles which do not permit even cooling and consequently damage the evenness of the thickness of the solidified skin. Belgian Pat. No. BE-A-675 403 discloses a device for cooling a continuously cast metal, by means of cooling bodies used in respect of the metal product during solidification. These cooling bodies are arranged in successive pairs spaced apart. They do not ensure even and adequate cooling and continuous support of the product throughout the secondary cooling zone. Further, they are subjected to wear and they are relatively complicated to install.

German Pat. No. DE-C-21 43 962 discloses apparatus for cooling and guiding a continuously cast product, comprising a grill in the links of which jets are disposed. The grill is pressed against the solidified lateral surface of the product which it guides. In this case, there are also problems of wear of the grill and deterioration in the quality of the product surface. Furthermore, the cooling achieved is not homogeneous over the entire surface.

SUMMARY OF THE INVENTION

An object of the present invention is to provide apparatus which remedies the above-mentioned disadvantages and ensures that the whole surface of the product is cooled homogeneously and intensely, at the same time ensuring that the product is supported uniformly and completely in the secondary cooling zone.

The invention provides apparatus for cooling a metal product manufactured by continuous casting, comprising at least one chamber having a plane anterior wall perforated with apertures and equipped with means of supplying pressurised cooling liquid, each chamber being disposed in the secondary cooling zone of the metal product in such as way that the wall perforated with apertures faces a surface of the metal product at a certain distance from the latter.

It has proven advantageous to arrange the chamber in such a manner that its anterior wall forms an angle of between 0° and 1° with the median transverse plane of the product in the direction of travel of the product. The median transverse plane of the product is the vertical plane at the half thickness of the product parallel to its major surfaces.

This advantageous arrangement results in the formation of a water wedge which prevents the cooling liquid from rising back up to the mold. This wedge effect is also accentuated by the contraction of the product on cooling.

According to a preferred embodiment of the apparatus of the invention, the apertures are slots oriented transversely with respect to the product when the chamber is positioned in the secondary cooling zone.

Preferably, these slots slant in the direction of travel of the metal product at an angle $\alpha$ of 20° to 70° with respect to the horizontal plane. Advantageously, the angle $\alpha$ is close to 60° in order to give the liquid a sufficient component of movement in the direction of movement of the metal product.

The cross-section of the apertures, and in particular the width of the slots, is preferably adjustable by appropriate means.

Preferably, the apertures or slots are regularly distributed in the anterior wall of the chamber in order to ensure a homogeneous distribution of the cooling liquid.

Other particular features of the invention will become apparent from the following description of a preferred embodiment of the apparatus and its method of operation, with reference to the accompanying drawings.

BRIEF DESCRIPTION OF THE DRAWINGS

In the drawings, the same elements are designated by the same reference numbers and the directions of flow of the liquid are indicated by arrows. Finally, everything which is not essential to an understanding of the invention has been omitted.

DESCRIPTION OF THE PREFERRED EMBODIMENT

Figure 1:
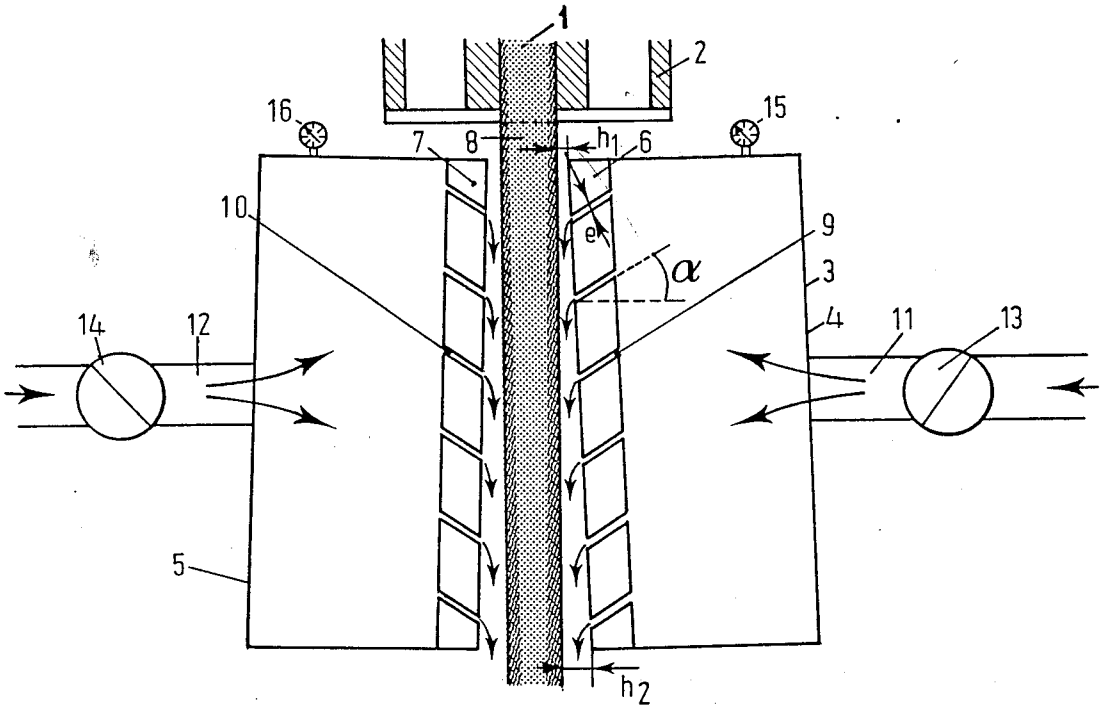
FIG. 1 is a diagrammatic representation of apparatus for cooling a continuously cast product, illustrating its method of operation.

FIG. 1 will first be referred to, being a diagrammatic representation, which is in no way limiting, of apparatus for cooling a steel slab manufactured by continuous casting.

As the slab 1 leaves the continuous casting mold 2 it enters the secondary cooling zone where the apparatus 3 according to the invention is installed. The apparatus 3 consists of two chamber 4,5, each of which has a plane anterior wall 6,7 facing the slab 1. The two chambers 4,5 are disposed at as small a distance as possible from the mold 2. However, if this distance permits, it may be possible to provide, between the mold 2 and the chambers 4,5, support rollers which are known per se and are not represented here. The two chamber 4,5 are arranged opposite the major surfaces of the slab 1 at the same level and in such a manner that their respective plane walls 6,7 slant with respect to the median plane of the slab. The slant is accentuated in FIG. 1 in order to be made noticeable, but in practice it does not exceed 1°. The chambers 4,5 are also mounted in such a manner that at any level their plane walls are at the same distance from the respective surface of the slab 1. Thus, at its highest point, each plane wall 6,7 is at a distance $h_1$ from the respective surface of the slab. Due to the slant of the chambers 4,5 the distance h between a chamber and the surface of the slab increases from $h_1$ at the top to $h_2$ at the bottom, where $h_1 < h_2$. For example, $h_1 = 1$ mm and $h_2 = 4$ mm for a chamber height of 60 cm.

The plane surfaces 6,7 of the chambers 4,5 are perforated with slots 9,10 which slant at an angle $\alpha = 30°$ with respect to the horizontal plane, in the direction of travel of the slab 1. The slots 9,10 have an adjustable width.

The chambers 4,5 also comprise pipes 11,12 for supplying the cooling liquid, as well as flow meters 13,14 to control the flow of the liquid and manometers 15,16 for checking the pressure existing inside the chambers.

The method of cooling a metal product manufactured by continuous casting, which is also part of the present invention, is also represented in FIG. 1.

When the steel slab 1 leaves the continuous casting mold 2, it has a relatively thin solidified skin enclosing the liquid core 8. The chambers 4,5 are supplied with pressurised water (or another cooling liquid) by the pipes 11,12 respectively and the water flows through the slots 9,10 to fill the space formed between the chambers 4 and 5. As it penetrates into this space, the slab 1 is subjected to the action of the cooling liquid which is flowing therein. It thus undergoes an intense, homogeneous cooling process which brings about the rapid solidification of the metal of the liquid core and thus the increase in thickness of the solidified skin. It is necessary to ensure a sufficient flow of cooling liquid to limit the heating of the liquid and in all events to prevent its boiling, since this would result in the rising of steam towards the mold.

In the space between the chambers, the slab is not in contact with any supporting member. It is only subjected to the action of the pressurised cooling liquid which, apart from its cooling effect, also ensures that the ferrostatic pressure applied by the metal of the liquid core is compensated. Since the pressure exerted by the layer of cooling liquid is applied uniformly over the whole surface of the slab, the ferrostatic pressure is compensated all over and there is no longer any risk of perforation.

Finally, the slant of the slots and the wedge effect resulting from the augmentation of the distance h severely limits the flow of water in the direction of the upper portion of the chambers and thus reduces the risk of splashing water on to the mold.

Figure 2:
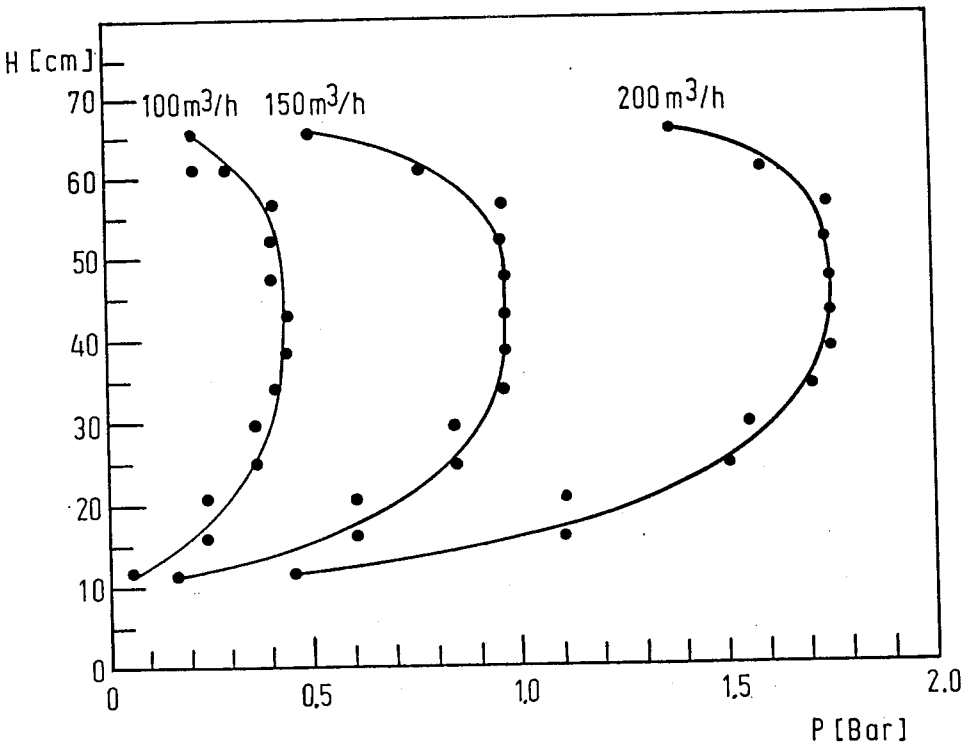
FIG. 2 is a graph representing the pressure distribution in the layer of cooling liquid for different rates of supply of the liquid.

FIG. 2 illustrates the distribution of pressure P, in bars, exerted on the surface of the slab along the height H of the chambers, in centimeters, for different flow rates of cooling liquid (100, 150, and 200 $m^3/h$).

The graph corresponds to a chamber height of 60 cm, with the distances $h_1 = 1$ mm and $h_2 = 4$ mm and with slots slanting at $\alpha = 30°$ and having a width of $e = 2.6$ mm. Tests carried out in these conditions have shown that the water flow is regular over the whole breadth of the slab as well as over the larger part of the height of the chambers. Further, the pressure exerted by the layer of water on the surface of the slab permits compensation of the ferrostatic pressure, since the latter is equal to about 1 bar just below the mold.

The apparatus and the method of the invention thus permit rapid, homogeneous cooling of a metal product manufactured by continuous casting, as well as the continuous support of the product throughout the duration of its solidification.

Obviously the invention is not limited to the embodiment which has just been described, but also includes variants which lie within the scope of the following claims.

We claim:

1. A method of cooling a continuously cast metal product in a secondary cooling zone below a continuous casting mold, the method comprising supplying pressurized cooling liquid to create, between the metal product and the anterior wall of a secondary cooling zone chamber, a continuous layer of pressurized cooling liquid flowing in the direction of travel of the metal product, the pressure in said layer of pressurized cooling liquid being such as to counterbalance the pressure of molten metal in the product wherein the anterior wall of the chamber slants at an angle of greater than 0° and not more than 1° with respect to a transverse median plane of the product in the direction of travel of the product.

2. The method of claim 1, in which the thickness of the continuous layer of cooling liquid increases in the direction of travel of the metal product.

3. Apparatus for cooling a continuously cast metal product in a secondary cooling zone below a continuous casting mold, the apparatus comprising at least one chamber having a plane anterior wall perforated with apertures, and means for supplying a pressurized cooling liquid to the apertures, each said chamber being disposed in the secondary cooling zone in such a manner that its anterior wall slants at an angle of greater than 0° and not more than 1° with respect to a transverse median plane of the product in the direction of travel of the product, such that each said anterior wall faces a surface of the metal product, at a given distance from the said surface which distance increases along the path of travel of said metal product.

4. The apparatus of claim 3, in which the apertures are slots oriented transversely with respect to the product.

5. The apparatus of claim 4, in which the slots slant in the direction of travel of the metal product at an angle of 20° to 70° with respect to the horizontal plane.

6. The apparatus of claim 5, in which the angle of slant of the slots is approximately 60°.

7. The apparatus of claim 3, in which the cross-section of the apertures is adjustable.

8. The apparatus of claim 3, in which the apertures are at regular intervals distributed along the anterior wall.

9. The apparatus of claim 3, in which there are two said chambers, each of whose anterior walls respectively face a major surface of the metal product.

* * * * *